US012349746B2

(12) United States Patent
Arangdad et al.

(10) Patent No.: US 12,349,746 B2
(45) Date of Patent: Jul. 8, 2025

(54) PROTECTIVE GARMENT HAVING ANTIVIRAL PROPERTIES IN COMBINATION WITH WATER RESISTANCE

(71) Applicant: Burlington Industries LLC, Greensboro, NC (US)

(72) Inventors: Kiarash Arangdad, Greensboro, NC (US); Nelson F. Bebo, III, Greensboro, NC (US); Guy C. Lucas, Charlotte, NC (US); William J. Dilanni, Kernersville, NC (US)

(73) Assignee: Burlington Industries LLC, Charlotte, NC (US)

( * ) Notice: Subject to any disclaimer, the term of this patent is extended or adjusted under 35 U.S.C. 154(b) by 0 days.

(21) Appl. No.: 17/534,618

(22) Filed: Nov. 24, 2021

(65) Prior Publication Data

US 2022/0160059 A1 May 26, 2022

Related U.S. Application Data

(60) Provisional application No. 63/118,048, filed on Nov. 25, 2020.

(51) Int. Cl.

| | |
|---|---|
| ***A41D 13/12*** | (2006.01) |
| ***A41D 31/10*** | (2019.01) |
| ***A41D 31/30*** | (2019.01) |

(52) U.S. Cl.

CPC ..... *A41D 13/12* (2013.01); *A41D 31/10* (2019.02); *A41D 31/305* (2019.02); *A41D 2500/10* (2013.01); *A41D 2500/20* (2013.01); *A41D 2500/30* (2013.01)

(58) Field of Classification Search

CPC ..... A41D 13/12; A41D 31/10; A41D 31/305; A41D 2500/10; A41D 2500/20; A41D 2500/30

See application file for complete search history.

(56) References Cited

U.S. PATENT DOCUMENTS

| | | | |
|---|---|---|---|
| 4,478,895 | A | 10/1984 | Makami et al. |
| 4,525,410 | A | 6/1985 | Hagiwara et al. |
| 4,721,511 | A | 1/1988 | Kupits |
| 4,781,973 | A | 11/1988 | Zotto et al. |
| 5,236,532 | A | 8/1993 | Taylor et al. |

(Continued)

FOREIGN PATENT DOCUMENTS

| | | | |
|---|---|---|---|
| WO | WO99/46118 | A1 | 9/1999 |
| WO | WO2014130940 | A1 | 8/2014 |

OTHER PUBLICATIONS

International Search Report Corresponding to Application No. PCT/US21/60725 on Jul. 6, 2022.

*Primary Examiner* — Khoa D Huynh
*Assistant Examiner* — Erick I Lopez
(74) *Attorney, Agent, or Firm* — Dority & Manning, P.A.

(57) ABSTRACT

Fabric materials are disclosed that have been treated with a water resistant and antimicrobial treatment. The water resistant and antimicrobial treatment includes a combination of a durable water resistant composition and an antiviral composition. Protective garments can be made from the fabric that provide protection against airborne pathogens by preventing penetration through the fabric material and by destroying any pathogens that land upon the fabric.

20 Claims, 7 Drawing Sheets

(56) References Cited

U.S. PATENT DOCUMENTS

| | | | | |
|---|---|---|---|---|
| 5,871,816 | A | 2/1999 | Tal | |
| 5,882,357 | A | 3/1999 | Sun et al. | |
| 6,192,520 | B1 | 2/2001 | Underwood et al. | |
| 7,581,260 | B2 | 9/2009 | Underwood et al. | |
| 7,754,625 | B2 | 7/2010 | Hendriks et al. | |
| 8,296,974 | B2 | 10/2012 | Sonnenschein et al. | |
| 8,793,814 | B1 | 8/2014 | Dilanni et al. | |
| 8,969,492 | B2 | 3/2015 | Fuchs et al. | |
| 9,487,912 | B2 | 11/2016 | Swamy et al. | |
| 10,294,608 | B2 | 5/2019 | Johnson | |
| 11,206,886 | B1 * | 12/2021 | Clarke | A01N 25/34 |
| 2005/0064020 | A1 | 3/2005 | Schuette et al. | |
| 2006/0156948 | A1 | 7/2006 | Hendriks et al. | |
| 2008/0152905 | A1 | 6/2008 | Hendriks et al. | |
| 2008/0160850 | A1 * | 7/2008 | Kimbrell | D03D 15/49 442/94 |
| 2008/0289090 | A1 * | 11/2008 | Brier | A41D 31/102 442/79 |
| 2011/0232653 | A1 * | 9/2011 | Imashiro | B32B 5/022 977/700 |
| 2015/0140047 | A1 | 5/2015 | Greenwald | |
| 2015/0239007 | A1 | 8/2015 | Selwyn | |
| 2016/0083900 | A1 * | 3/2016 | Johnson | D06M 11/83 8/116.1 |
| 2016/0090505 | A1 | 3/2016 | Sworen et al. | |
| 2016/0090560 | A1 | 3/2016 | Sworen et al. | |
| 2017/0030010 | A1 | 2/2017 | Baumann | |
| 2017/0204558 | A1 | 7/2017 | Knaup | |
| 2017/0231821 | A1 | 8/2017 | Addison et al. | |
| 2017/0314189 | A1 | 11/2017 | Curran et al. | |
| 2017/0347730 | A1 * | 12/2017 | Baychar | D04H 1/4374 |
| 2018/0044847 | A1 * | 2/2018 | Swamy | D06M 15/61 |
| 2018/0223458 | A1 | 8/2018 | Truesdale, III | |
| 2019/0030855 | A1 * | 1/2019 | Anantharamaiah | A61B 46/40 |
| 2019/0218348 | A1 | 7/2019 | Aydin et al. | |
| 2020/0093188 | A1 * | 3/2020 | Tanaka | A61F 13/8405 |
| 2020/0360735 | A1 * | 11/2020 | Cantin | A41D 31/065 |
| 2021/0106080 | A1 * | 4/2021 | Stangeland | D01D 5/20 |
| 2021/0227832 | A1 * | 7/2021 | McEntire | A61L 27/54 |

* cited by examiner 100 (ISO 5)

90 (ISO 4)

80 (ISO 3)

70 (ISO 2)

50 (ISO 1)

0

PROTECTIVE GARMENT HAVING ANTIVIRAL PROPERTIES IN COMBINATION WITH WATER RESISTANCE

RELATED APPLICATIONS

The present application is based on and claims priority to U.S. Provisional Patent Application Ser. No. 63/118,048, filed on Nov. 25, 2020, which is incorporated herein by reference.

BACKGROUND

First responders, medical personnel, and other public service providers are positioned to be on the front lines in treating patients with exposure to microorganisms, such as bacteria and viruses. For example, more virulent and drug resistant strains of pathogenic bacteria are being identified around the globe. The worldwide pandemic related to the Coronavirus, for instance, further accentuates the hazards faced by first responders and medical personnel.

First responders, including emergency medical personnel and firefighters, and other health care providers can be exposed to both bacteria and viruses in a direct manner or in an indirect manner. Protecting the above personnel from viruses, such as the Coronavirus, is particularly problematic. Viruses, for instance, reproduce by infecting a host cell and then multiply in great numbers. Recent studies have indicated that the infection rate of EMS responders and firefighters to the Covid 19 illness is much higher in relation to the general population. The transmission of microorganisms, such as viruses, from an infected patient to a first responder can occur in various ways. For example, coughing, sneezing, breathing and speaking can produce the airborne transmission of microorganisms. Coughing and sneezing, for instance, can produce relatively large respiratory droplets having a diameter of from about 10 microns up to about 1000 microns. Simply breathing and speaking also produces respiratory droplets, typically in a range of from about 0.8 microns to about 5.5 microns. These respiratory droplets are relatively invisible and create significant risk to those trying to help the infected. In addition to airborne transmission, the transmission of microorganisms can also occur through surfaces. For example, clothing made from textiles can provide a very large hosting surface for microorganisms. The Coronavirus, from instance, showed a relatively long survival time on cotton fabrics, particularly up to seven days. The Coronavirus can also survive on synthetic fibers for up to two days.

In view of the above, a need exists for improved protective garments for health care professionals and emergency responders. More particularly, a protective garment is needed that can protect the wearer against airborne droplets containing pathogens, particularly viruses. A need also exists for a protective garment that has effective antiviral properties. More particularly, a need exists for a protective garment that not only hinders penetration of respiratory water droplets carrying a virus but also provides antiviral features.

SUMMARY

In general, the present disclosure is directed to protective garments that can provide barrier protection against all different types of fluids and microorganisms, including bacteria and viruses. The present disclosure is also directed to protective garments that have antiviral properties. In addition, the present disclosure is directed to a fabric material that is used to produce the protective garments described above.

In one embodiment, for instance, the present disclosure is directed to a protective garment comprising a fabric material. The fabric material, for example, can comprise a woven fabric, a knitted fabric, a nonwoven fabric, or combinations thereof. The fabric material can also contain a film layer if desired. In accordance with the present disclosure, the fabric material includes a water resistant and antimicrobial treatment. The water resistant and antimicrobial treatment, for example, can impregnate the fabric as opposed to forming a distinct coating layer on the surface of the fabric. The water resistant and antimicrobial treatment contains a combination of a durable water resistant composition and an antiviral composition. The antiviral composition includes at least one antiviral agent.

Combining the durable water resistant composition with the antiviral composition provides various advantages and benefits. The durable water resistant composition, for instance, prevents respiratory vapors from penetrating the fabric. The durable water resistant composition can also serve to disperse and facilitate binding of the antiviral composition to the fabric fibers. The antiviral composition, which includes at least one antiviral agent, is designed to destroy microorganisms and/or prevent the growth of microorganism.

Any suitable antimicrobial agent can be incorporated into the antiviral composition. For instance, the antimicrobial agent can comprise a silver-containing material, such as silver metal particles or silver ion polymers, quaternary compounds such as quaternary silane or quaternary ammonium cations, pyrithione compounds including zinc pyrithione and/or sodium pyrithione, chitosan, copper-containing materials, triclosan, or mixtures thereof.

In one aspect, the antimicrobial agent can comprise silver ions, copper ions, or a mixture of silver and copper ions. The antimicrobial agent, for instant, can be any suitable ion-exchange type material. In one aspect, the antimicrobial agent can include a ceramic carrier for ion-exchanged metal ions. The ceramic carrier can comprise a zeolite. In addition to one or more antiviral agents, the antiviral composition can also contain various other components, such as an emulsifier and/or a binder.

In general, any suitable durable water resistant composition can be combined with the antimicrobial composition as long as the two compositions are compatible. In one aspect, for instance, the durable water resistant composition can include one or more fluorocarbons. When one or more fluorocarbons are present, the overall water resistant and antimicrobial treatment can be cationic in nature in order to prevent separation, settling or the formation of a precipitate.

In another aspect, the durable water resistant composition can be substantially fluorocarbon free. For example, the water resistant and antimicrobial treatment can contain one or more fluorocarbons, in one embodiment, in an amount less than about 1000 ppm, such as in an amount less than about 800 ppm, such as in an amount less than about 500 ppm, such as in an amount less than about 400 ppm, such as in an amount less than about 100 ppm, such as in an amount less than about 60 ppm, such as even in an amount less than about 10 ppm.

When formulated to be free of fluorocarbon polymers, the durable water resistant composition can contain at least one polyurethane polymer. The polyurethane polymer, for instance, may be a polyester/ether polyurethane polymer, such as an anionic aliphatic polyester/ether polyurethane. In one embodiment, the durable water resistant composition includes a first polyurethane polymer as described above combined with a second polyurethane polymer. The second polyurethane polymer may comprise a blocked isocyanate. The weight ratio between the first polyurethane polymer and the second polyurethane polymer can be from about 5:1 to about 1:2, such as from about 3:1 to about 1.5:1.

In addition to at least one polyurethane polymer, the fluorocarbon-free durable water resistant composition can contain various other components and ingredients. In one embodiment, for instance, the durable water resistant composition can contain a softener. The softener may comprise a polyalkylene polymer, such as a polyethylene polymer. The durable water resistant composition can also contain an acrylic polymer, a wax such as a paraffin wax, and mixtures thereof.

Protective garments made in accordance with the present disclosure can be used in all different types of applications. For example, the protective garment can be a medical garment, a lab coat, a public service uniform, or a fire-safety garment, such as a fireman's turnout coat. Medical garments include isolation gowns and surgical gowns. Especially when used in the medical field, the protective garment can provide a certain level of protection in accordance with standards established by the Association for the Advancement of Medical Instrumentation (AAMI). The AAMI, for instance, has promulgated different levels for barrier performance and has published guidelines for barrier classification. Protective garments made according to the present disclosure, for instance, can be designed to maintain a Level 1 protection, a Level 2 protection, a Level 3 protection, and even a Level 4 protection. The Level 4 protection garments, for instance, can, in one aspect, include a fabric material that includes a film layer positioned in between at least a first outer fabric layer and optionally a second outer fabric layer. Protective garments made according to the present disclosure can also have the above ratings and be durable. For instance, the protective garments can maintain a desired AAMI rating even after 60 laundry cycles, such as after 75 laundry cycles, such as after 100 laundry cycles.

Especially when being used to produce medical garments, the fabric used to make the protective garment can be a woven fabric made from polyester yarns. The polyester yarns can comprise multifilament yarns. In one aspect, the woven fabric can contain from about 80 to about 180 warp yarns per inch and from about 60 to about 110 fill yarns per inch. The basis weight of the fabric can be from about 1.8 osy to about 3.2 osy, such as from about 2.3 osy to about 2.8 osy. The fabric can also be calendered in order to improve the barrier properties of the fabric. In one aspect, the protective garment can be made from a single layer of the fabric.

In an alternative embodiment, the protective garment may be designed for fire service applications and may contain inherently flame resistant fibers. The inherently flame resistant fibers, for instance, may include para-aramid fibers, meta-aramid fibers, polybenzimidazole fibers, and mixtures thereof. In one embodiment, the outer shell material contains inherently flame resistant fibers in an amount of at least about 60% by weight. The fabric material can be formed from yarns of the inherently flame resistant fibers. The yarns can be multifilament yarns, spun yarns, stretch-broken yarns, monofilament yarns, and mixtures thereof. In one embodiment, the fabric material can be made from a combination of spun yarns and multifilament yarns.

Due to the presence of the durable water resistant composition, fabric materials made according to the present disclosure can display excellent water resistant properties. For instance, the fabric material can maintain a water absorption of less than about 15%, such as less than about 10%, after 5 laundry cycles or after 10 laundry cycles. The fabric material can also maintain a spray rating of at least 70, such as at least 80, such as at least 90, after 10 laundry cycles.

As described above, the water resistant and antimicrobial treatment applied to the fabric material contains a durable water resistant composition in combination with an antiviral composition. In one aspect, both compositions are combined together and applied to the fabric material. In other embodiments, however, the compositions can be applied to the fabric material separately. The water resistant and antimicrobial treatment can be applied to the fabric material as a spray or the fabric material can be dipped into a bath containing the water resistant and antimicrobial treatment. The treatment can also be applied to the fabric material as a foam.

The water resistant and antimicrobial treatment can be specially formulated in order to make sure that all of the components are compatible. In one embodiment, for instance, the water resistant and antimicrobial treatment may be cationic. In an alternative embodiment, the water resistant and antimicrobial treatment can be nonionic. The treatment can be nonionic, for instance, when formulating a fluorocarbon free formulation. The water resistant and antimicrobial treatment can be applied to the fabric material at a solid add on level of from about 0.5% to about 5% by weight, such as from about 1% to about 3% by weight.

Other features and aspects of the present disclosure are discussed in greater detail below.

BRIEF DESCRIPTION OF THE DRAWINGS

A full and enabling disclosure of the present disclosure is set forth more particularly in the remainder of the specification, including reference to the accompanying figures, in which.

DEFINITIONS AND STANDARDIZED PROCEDURES

Figure 1:
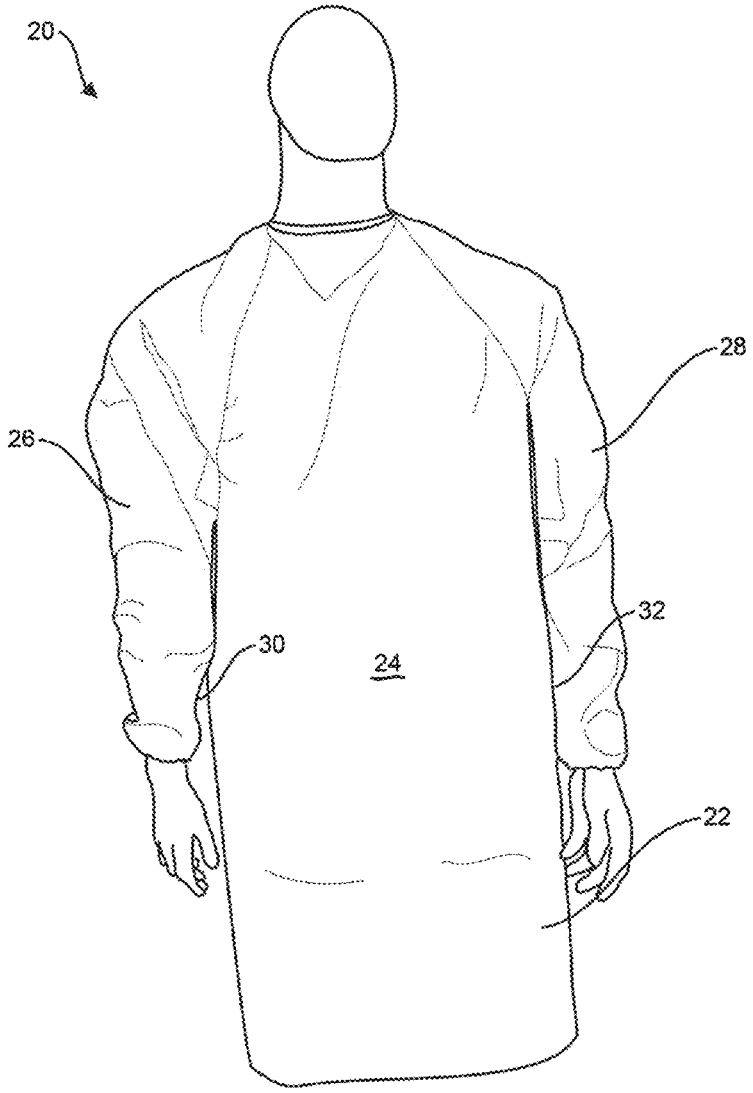
FIG. 1 is a perspective view of one embodiment of a front of a protective garment made in accordance with the present disclosure.

The following definitions and procedures are offered in order to better describe and quantify the performance of protective garments and fabrics made according to the present invention in comparison to prior art constructions.

The teachings of the present disclosure are particularly well suited to constructing protective garments for the medical industry.

When used in the healthcare industry, for example, the protective garment of the present disclosure can be rated according to the Association for the Advancement of Medical Instrumentation (AAMI). The current AAMI standard is described in "Liquid Barrier Performance and Classification of Protective Apparel and Drapes Intended for Use in Health Care Facilities," ANSI/AAMI PB70:2012. This AAMI standard helps to preserve the sterile field and protect health care workers during surgery and other health care procedures during which exposure to blood, body fluids and other potential infectious material might occur. This AAMI standard establishes a system of classification and associated minimum requirements for protective apparel such as gowns and drapes used in health care facilities based on their liquid barrier performance.

The present AAMI standard for liquid barrier performance is provided in the following table:

TABLE 1

AAMI Barrier Protection Levels

| AAMI Level | Test | Result |
|---|---|---|
| 1 | AATCC 42:2017e | ≤4.5 grams |
| 2 | AATCC 42:2017e | ≤1.0 gram |
| | AATCC 127:2017 | ≥20 cm |
| 3 | AATCC 42:2017e | ≤1.0 gram |
| | AATCC 127:2017 | ≥50 cm |
| 4 | Gowns: ASTM F1671/F1671 M-13 | Pass |
| | Drapes: ASTM F1670/F1670 M-17a | Pass |

Water Repellency: Spray Test AATCC TM22-2017.

As used herein, a fabric spray rating refers to a rating a fabric or a material receives according to AATCC TM22-2017. In general, a spray test measures the resistance of a material to wetting by water.

According to the present invention, the following is the procedure used to determine the spray rating of a material.

1. A 7×7" sample of the material to be tested is first conditioned at 65 plus or minus 2% relative humidity and at 70 plus or minus 2° F. for a minimum of four hours prior to testing.
2. The fabric sample is fastened securely on a 6" metal hoop so that the fabric is wrinkle free. The hoop is supported on a tester's stand so that the fabric is facing up. Twills, gabardines, piques or similar fabrics of ribbed construction are positioned on the stand so that the ribs are diagonal to the flow of water running off the fabric. A funnel attached to a nozzle for holding water is placed 6" above the center of the fabric.
3. 250 milliliters of water at 80 plus or minus 2° F. are poured from a cup or other container into the funnel, allowing the water to spray onto the fabric.
4. Once the water has run through the funnel, one edge of the hoop is held and the opposite edge is firmly rapped once against a solid object with the fabric facing the object. The hoop is then rotated 180° and it is rapped once more at the point previously held.
5. The wetted or spotted fabric sample is then compared with the standards shown in FIGS. 5A-5F. The fabric is assigned a spray rating that corresponds to the nearest standard. As shown on FIGS. 5A-5F, the fabric can be rated from 0 to 100 wherein 0 indicates that the entire fabric is wetted with the water, while a rating of 100 indicates that none of the fabric was wetted by the water.

Aqueous Liquid Repellency: Water/Alcohol Solution Resistance Test (AATCC TM193-2017)

The following standardized water repellency test determines a material's resistance to wetting by aqueous liquids. In general, drops of a water-alcohol mixture of varying surface tensions are placed on the surface of the material and the extent of surface wetting is determined visually. The higher the rating a material receives is an indication of the material's resistance to staining by water-based substances. The composition of standard test liquids is as follows:

TABLE 1

Standard Test Liquids

| Water Repellency | Composition | |
|---|---|---|
| Rating Number | Isopropanol, % | Distilled Water, % |
| 1 | 2 | 98 |
| 2 | 5 | 95 |
| 3 | 10 | 90 |
| 4 | 20 | 80 |
| 5 | 30 | 70 |
| 6 | 40 | 60 |
| 7 | 50 | 50 |
| 8 | 60 | 40 |

The water repellency procedure is as follows:

1. An 8"×8" sample of material is first conditioned at 65 plus or minus 2% relative humidity and at 70 plus or minus 2° F. for a minimum of four hours. The fabric is placed horizontally face up on white blotting paper.
2. Beginning with test liquid number 1, one drop of the liquid is placed at three locations on the material. Each drop placed on the material should be 2" apart.
3. The material is observed for 10 seconds from an approximate 45° angle.
4. If two of the three drops have not wet the fabric or do not show leaking into the fabric, drops of test liquid number 2 are placed on an adjacent site and step number 3 is repeated.
5. This procedure is continued until 2 of the 3 drops have wet or show wicking into the fabric. The water repellency rating is the highest numbered liquid for which 2 of the three drops do not wet or wick into the fabric.

Dimensional Changes of Fabrics after Home Laundering AATCC TM135-2018

Laundering is preferably performed in an automatic washer, followed by drying in an automatic dryer. The following laundering test is used to determine the fabric's ability to withstand laundering. Typically, after laundering, the fabric is then subjected to the above-described spray test, water repellency test, and oil repellency test.

1. 8"×10" test specimens are combined with load fabrics (hemmed pieces of cotton sheeting or 50:50 fabric sheets having a size of 36"×36") to give a total dry load of 4 pounds.
2. The dials on the washer are set as follows:

| | |
|---|---|
| Water Level | High |
| Wash | Cycle Normal, 12 minutes |
| Temperature | Warm Wash, 105° F.; Cold Rinse |

The test pieces and dummy load are placed in the washer and the machine is started. One ounce of TIDE (Proctor & Gamble) detergent is added while the washer is filling with soft water. If the water hardness is greater than 5 ppm, CALGON water softener (Nalco) in the amount specified by the manufacturer is added to soften the water.

3. After the washing is complete, the wet fabric including the dummy load is placed in the automatic dryer. The dryer temperature dial is set to the proper point under high heat to give a maximum vent temperature of from about 155° F. to about 160° F. The time dial is set for "Normal Cycle" for 45 minutes. The machine is started and drying is allowed to continue until the cycle is complete. The above represents one laundry cycle.

4. The fabrics are then rewashed and redried until 10 cycles have been completed. Optionally, the test fabrics can be pressed with a hand iron, or the equivalent, at 280° F. to about 320° F. for 30 seconds on each side with the face side pressed last. The fabrics are then conditioned before testing for water is, repellency, oil repellency, or spray rating. As used herein, water repellency, oil repellency and spray ratings are all determined without ironing the fabric after being laundered, unless otherwise denoted.

Water Absorption Resistance Test

The following water absorption test is for determining the resistance to water absorption of a fabric or material. The test is based upon NFPA 1971-2018, 8-25. In particular, the water absorption test is conducted according to the above-identified test method after the fabric or material has been subjected to five laundry cycles in accordance with NFPA 1971, 8-1.2 (or AATCC TM135-2018-1, V, Ai).

According to the present invention, the following is the procedure used to determine the water absorption rating of a material.

1. Three 8"×8" samples of the material to be tested are subjected to five laundry cycles in accordance with NFPA 1971, 8-1.2. Test method NFPA 1972, 8-1.2 is substantially similar to the laundering test described above. In this test, however, the specimens are conditioned in an atmosphere of 70 plus or minus 2° F. and 65 plus or minus 2% relative humidity before and after being washed. Further, the machine settings and parameters are as follows:

| | |
|---|---|
| water level | normal |
| wash cycle | normal/cotton sturdy |
| wash temperature | 140 + or − 5° F. |
| drying cycle | tumble/cotton sturdy |
| detergent | 66 + or − 1 g of 1993 AATCC standard Reference Detergent |

2. Each sample is securely mounted, with the coated side of the material up, to embroidery hoops with sufficient tension to ensure a uniformly smooth surface. The hoop is supported on a tester's stand. The material is positioned so that the direction of the flow of water down the sample shall coincide with the warpwise direction of the sample as placed on the stand. A funnel attached to a nozzle for holding water is placed 24" above the center of the material. The plane of the surface of the sample is placed at a 45° angle with the horizontal.

3. 500 ml of water at a temperature of 80+ or −2° F. are poured quickly into the funnel and allowed to spray onto the specimen.

4. As rapidly as possible, the sample is removed from the hoops and placed between two sheets of blotting paper on a flat horizontal surface. A metal roller approximately 41/2" long and weighing 21/4 pounds is rolled quickly forward and back one time over the paper without application of any pressure other than the weight of the roller.

5. A square having dimensions of 4"×4" is cut out of the center of the sample and weighed to the nearest 0.05 grams. Not more than 30 seconds shall elapse between the time the water has ceased flowing through the spray nozzle and the start of the weighing.

6. The same 4"×4" square sample is then left in a conditioning room until it has dried and reached moisture equilibrium with the surrounding atmosphere. The sample is then weighed again.

7. The water absorbed shall be calculated as follows:

$$\text{water absorbtion percent} = \frac{W - O}{O} \times 100$$

herein W is the weight of the wet sample and O is the weight of the dried sample. The water absorption rating of the sample is the average of the results obtained from the three specimens tested.

Water Repellency: Tumble Jar Dynamic Absorption Test

The following test also measures the water-repellent efficacy of finishes applied to fabrics, because the test subjects the treated fabrics to dynamic conditions similar to those often encountered during actual use. The test conforms to AATCC TM70-2015.

According to the present invention, the following is the procedure used to determine the dynamic water absorption rating of a material.

1. During the test, two specimen sets are tested. Each specimen set consists of five 8"×8" pieces of the material. For each piece that is cut, the corner yarns are removed and, if necessary, a drop of liquid latex or rubber cement is placed at the corners to prevent raveling. Prior to testing, each piece of material is conditioned at 65+ or −2% relative humidity and at 70+ or −2° F. for a minimum of four hours. Blotting paper to be used later is also conditioned.

2. The five pieces of each specimen set are rolled together and weighed to the nearest 0.1 gram.

3. Two liters of distilled water at 80+ or −2° F. is poured into the tumble jar of a dynamic absorption tester. The dynamic absorption tester should consist of a motor driven, 6 liter cylindrical or hexagonal-shaped jar approximately 6" in diameter and 12" in length, mounted to rotate end over end at 55+ or −2 rpm with a constant tangential velocity. The jar may be of glass, corrosion resistant metal, or chemical stoneware.

4. Both specimen sets are placed into the jar and the jar is rotated in the tester for 20 minutes.

5. A piece of one specimen set is then immediately passed through a ringer at a rate of 1" per second with the edge of the piece parallel to the rolls. The piece is sandwiched between two pieces of unused blotter paper and passed through the ringer again. The piece is left sandwiched between the wet blotters. The process is then repeated for the remaining four pieces of the specimen set. The blotters are removed and the five pieces are rolled together, put in a tared plastic container or gallon-sized zippered plastic bag and the wet specimen set is weighed to the nearest 0.1 gram. The mass of the wet specimen set should not be more than twice its dry mass.

6. Step number five is repeated for the second specimen set.

7. The dynamic water absorption for each specimen set is calculated to the nearest 0.1% using the following equation:

$$WA=(W-C)/C\times 100$$

where

WA=water absorbed, percent

W=wet specimen weight, g

C=conditioned specimen weight, g.

8. The dynamic water absorption of the material is determined by averaging together the water absorbed by each of the two specimen sets.

9. According to the present invention, the dynamic water absorption rating of the material can be determined after laundering the samples in accordance with NFPA 1971, 8-1.2. For instance, the samples can be tested after 10 laundry cycles and after 20 laundry cycles to determine the durability of the water resistant coating.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only and is not intended as limiting the broader aspects of the present disclosure.

In general, the present disclosure is directed to a protective garment that is particularly well suited to protecting the user from fluids and providing an impenetrable barrier to many liquids. In addition, protective garments made in accordance with the present disclosure have antimicrobial properties and are particularly adapted to destroy and kill viruses that come in contact with the protective garment. In accordance with the present disclosure, the protective garments are made from a fabric material that includes a water resistant and antimicrobial treatment. The water resistant and antimicrobial treatment is a combination of a durable water resistant composition blended (at least on the fabric or fiber surfaces) with an antiviral composition. The combined properties of the water resistant and antimicrobial treatment not only hinder penetration of respiratory water droplets that may contain a pathogen, such as a virus, but also provide antiviral features once the fabric material comes into contact with a virus. Of particular advantage, treated fabric materials in accordance with the present disclosure also have excellent durability and can display the above properties after multiple laundry cycles.

As learned from the recent Coronavirus pandemic, pathogens, particularly viruses, can remain in aerosol for hours and transmission through respiratory droplets is particularly problematic. In addition, microorganisms such as viruses, can survive even up to a few days on a fabric surface. Consequently, protective garments are needed especially for first responders and healthcare personnel that are day to day on the front lines of treating patients infected with diseases causes by microorganisms. In fact, during the pandemic, the number of first responders that have been infected with the Coronavirus is alarming. Protective fabrics and protective garments made according to the present disclosure are capable of preventing the penetration of respiratory droplets and have antimicrobial properties that kill and destroy viruses.

Protective garments made in accordance with the present disclosure can be used in all different types of fields and applications. The protective garments, for instance, can be used by healthcare personnel and/or by patients and can include daily medical wear or can include more specialized garments, such as gowns, lab coats, and the like. Protective garments made in accordance with the present disclosure can also include fire safety garments and apparel. Such protective garments can include footwear, trousers, jackets, coats, shirts, headwear, gloves, and the like. The protective garment can be a one-piece jumpsuit or can comprise a uniform, such as a military garment, tactical garment, firefighter garment, industrial garment, police garment, battle dress uniform, and the like.

As described above, protective garments in accordance with the present disclosure are made from a fabric material that includes a water resistant and antimicrobial treatment. The water resistant and antimicrobial treatment is a combination of a durable water resistant composition and an antiviral composition. Although each composition can be applied to the fabric material separately, in one aspect, both compositions can be combined together and applied to the fabric material in one step, such as through a dipping process.

In general, many durable water resistant compositions and antiviral compositions are relatively incompatible and cannot remain together as a stable liquid. Instead, due to the incompatibility of the components, the liquid can form a precipitate, can become cloudy, or can otherwise simply not bind to a fabric substrate. The water resistant and antimicrobial treatment of the present disclosure, however, has been specially formulated in order to remain stable. In fact, it was discovered that the durable water resistant composition can actually promote the uniform application of the antiviral composition and assist or facilitate binding of the antiviral agent to fibers contained in the fabric material.

Any suitable antimicrobial agent can be incorporated into the antiviral composition. For instance, the antimicrobial agent can comprise a silver-containing material, such as silver metal particles or silver ion polymers, quaternary compounds such as quaternary silane or quaternary ammonium cations, pyrithione compounds including zinc pyrithione and/or sodium pyrithione, chitosan, copper-containing materials, triclosan, or mixtures thereof.

Each antimicrobial agent can be present on the fabric in any suitable amount depending upon the particular application and the particular antimicrobial agent selected. For example, the antimicrobial agent can be present on the fabric in an amount greater than about 0.001% by weight, such as in an amount greater than about 0.01% by weight, such as in an amount greater than about 0.1% by weight, such as in an amount greater than about 0.5% by weight, such as in an amount greater than about 0.7% by weight, such as in an amount greater than about 1% by weight, such as in an amount greater than about 2% by weight, such as in an amount greater than about 3% by weight. Each antimicrobial agent is generally present on the fabric in an amount less than about 30% by weight, such as in an amount less than about 20% by weight, such as in an amount less than about 10% by weight, such as in an amount less than about 5% by weight, such as in an amount less than about 3% by weight, such as in an amount less than about 1.5% by weight, such as in an amount less than about 1% by weight.

The antiviral composition of the present disclosure can contain one or more antiviral agents. In one aspect, the antiviral agent comprises a metal ion. In one aspect, for example, a metal ion containing ion-exchange agent is used. Alternatively, the antiviral agent can be a water soluble salt or water soluble particles containing free metal ions. Metal ions that may be included in the antiviral agent include, for instance, silver, copper, zinc, gold, iron, cobalt, nickel, manganese, antimony, bismuth, barium, cadmium, chromium, and mixtures thereof. In one aspect, the metal ions are silver, copper, gold, zinc and combinations thereof. In one particular embodiment, for instance, the antiviral agent can comprise silver ions alone or in combination with copper ions, zinc ions, or both copper ions and zinc ions.

Ion-exchange type antiviral agents are typically characterized as comprising an ion-exchange capable ceramic particle having ion-exchanged antiviral metal ions, i.e., the antiviral metal ions have been exchanged for (replaced) other nonantiviral effective ions in and/or on the ceramic particles. While these materials may have some surface adsorbed or deposited metal, the predominant antiviral effect is as a result of the ion-exchanged antiviral metal ions released from within the ceramic particles themselves.

Antiviral ceramic particles include, but are not limited to zeolites, calcium phosphates, hydroxyapatite, zirconium phosphates and other ion-exchange ceramics. These ceramic materials come in many forms and types, including natural and synthetic forms. For example, the broad term "zeolite" refers to aluminosilicates having a three dimensional skeletal structure that is represented by the formula: XM2/nO—Al2O3-YSiO2-ZH2O wherein M represents an ion-exchangeable ion, generally a monovalent or divalent metal ion; n represents the atomic valence of the (metal) ion; X and Y represent coefficients of metal oxide and silica, respectively; and Z represents the number of water of crystallization. Examples of such zeolites include A-type zeolites, X-type zeolites, Y-type zeolites, T-type zeolites, high-silica zeolites, sodalite, mordenite, analcite, clinoptilolite, chabazite and erionite.

Generally speaking, the ion-exchange type antiviral agents used in the practice of the present invention are prepared by an ion-exchange reaction in which non-antiviral ions present in the ceramic particles, for example sodium ions, calcium ions, potassium ions and iron ions in the case of zeolites, are partially or wholly replaced with the antiviral metal ions, for example, copper and/or silver ions. The combined weight of the antiviral metal ions will be in the range of from about 0.1 to about 35 wt. %, preferably from about 1 to 25 wt. %, more preferably from about 2 to about 20 wt. %, most preferably, from about 2.5 to 15 wt. %, of the ceramic particle based upon 100% total weight of ceramic particle. Where the ceramic particles include two or more different antiviral metal ions, each antiviral metal ion is typically present in and amount of from about 0.1 to about 25 wt %, preferably from about 0.3 to about 15 wt. %, most preferably from about 2 to about 10 wt. % of the ceramic particle based on 100% total weight of the ceramic particle.

In one aspect, the particles can contain both silver ions in combination with copper ions and optionally with an organosilane-based quaternary ammonium compound. In these instances, the weight ratio of silver to copper ions is from 1:10 to 10:1, preferably from 5:1 to 1:5, most preferably from 2.5:1 to 1:2.5. In an especially preferred embodiment, the ceramic particle contains from about 0.3 to about 15 wt. % of silver ions and from about 0.3 to about 15 wt, % of copper ions in a weight ratio of 5:1 to 1:5. Exemplary compositions are disclosed in US 2006/0156948A1 and 2008/0152905A1, both of which are incorporated herein by reference in their entirety.

The antiviral ceramic particles may also contain other ion-exchanged ions for various purposes, particularly ions that improve color stability of the fabrics and/or overall stability and/or ion release characteristics of ceramic particles. An exemplary and preferred other ion is ammonium ion.

The preferred antiviral ion-exchange agents are the antiviral aluminosilicates, specifically the zeolites. A number of different grades and types of antiviral zeolites are commercially available including about 0.6% silver; about 2.5% silver; about 2.5% silver, 14% zinc, and 0.5%-2.5% ammonium ions; and about 6.0% copper and about 3.5% silver.

The above metal ions are described as having antiviral properties. It should be understood, however, that the metal ions are also very effective against all different types of microorganisms, including bacteria and/or fungi. In this regard the metal ions may also be referred to as antimicrobial agents.

The one or more antiviral agents as described above can be applied to the fabric material in accordance with the present disclosure in an amount sufficient to destroy and kill microorganisms that come in contact with the fabric material, including the Coronavirus. In general, the one or more antimicrobial agents are applied to the fabric material in an amount from about 0.05 gsm to about 2 gsm, including all increments of 0.05 gsm there between. For instance, the one or more antiviral agents can be applied to a fabric material in an amount greater than about 0.1 gsm, such as greater than about 0.3 gsm, such as greater than about 0.5 gsm, such as greater than about 0.7 gsm, and generally less than about 1.5 gsm, such as less than about 1.3 gsm, such as less than about 1 gsm, such as less than about 0.7 gsm.

The antiviral composition contained in the water resistant and antimicrobial treatment can contain one or more antiviral agents in combination with a binder. Binders that may be used include polyurethanes and/or acrylics. In accordance with the present disclosure, a binder can be selected that is compatible with the durable water resistant composition. For example, a particular binder can be selected that is cationic, nonionic or even anionic depending upon the components of the remainder of the treatment composition. In one embodiment, for instance, an acrylic based binder is used. The binder can be present in the antiviral composition generally in an amount from about 0.1% by weight to about 60% by weight, including all increments of 1% by weight therebetween. For example, the binder can be present in the antimicrobial composition in an amount greater than about 1% by weight, such as in an amount greater than about 3% by weight, such as in an amount greater than about 5% by weight and generally in an amount less than about 40% by weight, such as in an amount less than about 30% by weight, such as in an amount less than about 20% by weight, such as in an amount less than about 15% by weight.

In one particular aspect, the antimicrobial composition contains zeolite particles containing silver in an amount from about 3% to about 15% by weight, such as in an amount from about 7% to about 12% by weight. The antiviral composition can also contain zeolite particles containing both silver and copper ions generally in an amount from about 6% by weight to about 20% by weight, such as in an amount from about 11% by weight to about 17% by weight. The antiviral composition can also contain an acrylic polymer binder generally in an amount from about 12% to about 35% by weight, such as in an amount from about 22% to about 28% by weight. Optionally, the antiviral composition can also contain a polyurethane resin in relatively minor amounts, such as in amounts from about 0.5% to about 3% by weight. The remainder of the antiviral composition can comprise water alone or in combination with a glycol, such as propylene glycol. Propylene glycol, for instance, can be present in the antimicrobial composition in an amount from about 0.5% to about 4% by weight.

The water resistant and antimicrobial treatment of the present disclosure includes a combination of an antiviral composition as described above and a durable water resistant composition. The durable water resistant composition prevents liquids from being absorbed by the fabric material. The durable water resistant composition can also make the fabric material resistant to oil, various solvents, and can make the fabric material more abrasion-resistant. In one aspect, the durable water resistant composition is made from a solution containing a fluorocarbon polymer, such as a polytetrafluoroethylene polymer, particularly a C6 polytetrafluoroethylene polymer. When containing a fluorocarbon polymer, the durable water resistant composition can also contain a wetting agent, an extender, and optionally a binder.

Fluorinated durable water resistant compositions can be water and oil repellent compositions containing a copolymer made of side chain fluorotelomer based polymers. Once applied to the fabric, the polymer particle spreads to cover the fabric surface during drying and curing. The fluoroalkyl chains orient perpendicular to the fabric surface to provide low surface energy and enhance the oleophobic properties of textiles. In one aspect, the durable water resistant composition contains a C6 fluorocarbon polymer.

In an alternative embodiment, the durable water resistant composition is free or substantially free from fluorocarbon chemicals. Substantially free, as used herein, indicates that the fabric contains fluorocarbon chemicals in an amount less than about 2% by weight, such as in an amount less than about 1% by weight, such as in an amount less than about 0.5% by weight, such as in an amount less than about 0.25% by weight, such as in an amount less than about 0.1% by weight. In one embodiment, the durable water resistant composition is free or is substantially free of perfluorinated carboxylic acids, such as free or substantially free of perfluorooctanoic acid. For example, perfluorooctanoic acid or any perfluorinated carboxylic acids may be present in the durable water resistant composition and/or in a treated fabric in an amount less than about 2% by weight, such as in an amount less than about 1% by weight, such as in an amount of less than 0.5% by weight, such as in an amount less than about 0.25% by weight, such as in an amount less than about 0.1% by weight.

In another embodiment, the durable water resistant composition can be free or substantially free of polyfluoroalkyl compounds, including C6 compounds. For instance, the durable water resistant composition and/or the treated fabric can contain one or more polyfluoroalkyl compounds in an amount less than about 2% by weight, such as in an amount less than about 1% by weight, such as in an amount less than about 0.5% by weight, such as in an amount less than about 0.25% by weight, such as in an amount less than about 0.1% by weight.

The fluorocarbon free durable water resistant composition contains a binder and/or an extender combined with various other ingredients and components. For instance, the durable water resistant composition can also include a softener, a repelling agent, or both a softener and a repelling agent.

The binder contained in the durable water resistant composition, in one embodiment, can comprise a polyurethane polymer. Of particular advantage, the polyurethane polymer can be water-based and thus can be applied to the fabric in an aqueous dispersion. In one embodiment, the polyurethane polymer is an anionic polyurethane. The polyurethane polymer can also be an aliphatic polyurethane. In one particular embodiment, the polyurethane polymer that makes up the binder is a polyester/ether polyurethane polymer, such as an aliphatic polyester/ether polyurethane polymer.

Optionally, the above binder can be combined with an extender. The extender may also comprise a polyurethane polymer. Thus, in one embodiment, the durable water resistant composition includes a first polyurethane polymer combined with a second polyurethane polymer. The extender, for instance, can comprise a modified polyurethane polymer. For instance, the extender may be a blocked isocyanate, such as an oxime-blocked isocyanate. The extender can be cationic or nonionic. The extender is for further increasing water and oil resistance.

In addition to a binder and/or an extender, in one embodiment, the durable water resistant composition can further include a softener. The softener, for instance, may comprise an emulsion of a polyalkylene polymer. The softener is generally nonionic. In one embodiment, the softener is a polyethylene polymer, such as a lower molecular weight polyethylene polymer.

In one embodiment, the durable water resistant composition may also contain a repelling agent. The repelling agent may include an acrylic polymer alone or in combination with a wax, such as a paraffin wax. In one embodiment, the repelling agent may include a polyacrylate that also serves as a binder.

Each of the above ingredients can be combined with water and optionally a wetting agent, such as isopropyl alcohol for application to a fabric. The relative amounts of each component can vary depending on the particular formulation. In one embodiment, for instance, the binder or first polyurethane can be present in relation to the extender or second polyurethane in a weight ratio of from about 5:1 to about 1:2, such as in a weight ratio of from about 4:1 to 1:1. In one embodiment, the binder and extender are present in a weight ratio of from about 3:1 to about 1.5:1 based on the dried weight of the finish. The repelling agent can be present in amounts greater than the binder or the extender. For instance, the weight ratio (based on the dried weight of the finish) between the binder or extender and the repelling agent can be from about 3:1 to about 1:8, such as from about 1:1 to about 1:5, such as from about 1:1.5 to about 1:3.

When included in the formulation, the softener can generally be present in amounts less than the binder, the repelling agent or the extender. For example, in one embodiment, the softener can be present in relation to the binder in a weight ratio of from about 1:1 to about 1:4, such as from about 1:1.5 to about 1:3.

As described above, the durable water resistant composition and the antiviral composition can both contain a binder. In one aspect, only a single binder can be used in the combined formulation. In other embodiments, however, multiple binders can be used as desired.

As described above, the durable water resistant composition and the antiviral composition can be applied to the fabric material separately. Efficiencies and various advantages can be obtained, however, if the durable water resistant composition and the antiviral composition are combined together and applied to the fabric material at the same time as a single water resistant and antimicrobial treatment. Prior to applying the water resistant and antimicrobial treatment, the fabric material can optionally be scoured using, for instance, an alkaline solution. After being scoured, the fabric material can be put on a tenter frame, dried, and heat seat. For instance, after scouring, the fabric material can be dried so that the moisture level is substantially equivalent to the natural moisture level of the fibers used to make the fabric material. For instance, the moisture level can be less than about 10% by weight, such as less than about 7% by weight, and generally greater than about 3% by weight.

After the fabric material has been dried and heat set, the water resistant and antimicrobial treatment can be applied to at least one side of the fabric material. Although the treatment can be sprayed onto the fabric material as a liquid or foam or printed onto the fabric material, in one aspect, the fabric material is dipped into a bath containing the water resistant and antimicrobial treatment.

The composition of the water resistant and antimicrobial treatment can vary depending on the fabric being treated and the components contained in the treatment. In one aspect, when applying a water resistant and antimicrobial treatment containing a fluorocarbon polymer, the composition can contain the following as an example (remainder water):

| Component | % WT |
|---|---|
| Acid | 0.01 to 1.4 |
| Wetting Agent | 0.01 to 1.6 |
| Fluorinated DWR | 4 to 12 |
| Extender | 0.5 to 5 |
| Antimicrobial/Antiviral | 4.5 to 14 |

In another aspect, when applying a water resistant and antimicrobial treatment that is fluorocarbon-free, the composition can contain the following as examples (remainder water):

| Component | % WT |
|---|---|
| Wetting Agent | 0.01 to 1.4 |
| Extender | 0.5 to 5.5 |
| Fluorine free DWR | 7.5 to 14 |
| Antimicrobial/Antiviral | 3 to 9 |

| Component | % WT |
|---|---|
| Wetting Agent | 0.01 to 1.4 |
| Abrasion Resistant Agent | 1.5 to 9 |
| Anti-Raveling Agent | 2.5 to 11 |
| Extender | 2.5 to 11 |
| Fluorine free DWR | 15 to 25 |
| Antimicrobial/Antiviral | 3 to 10 |

The amount of the water resistant and antimicrobial treatment applied to the fabric material will depend upon the particular formulation and the particular application. The dry add on can be greater than about 0.5% by weight, such as greater than about 1% by weight, such as greater than about 1.5% by weight, such as greater than about 2% by weight, such as greater than about 2.5% by weight, such as greater than about 3% by weight, and generally less than about 7% by weight, such as less than about 5% by weight, such as less than about 4% by weight, such as less than about 3.5% by weight.

After the water resistant and antimicrobial treatment is applied to the fabric material, the fabric material is then heated to a temperature sufficient for the treatment composition to dry and/or cure. The fabric material then can be used in constructing various protective garments in accordance with the present disclosure.

Fabric materials treated according to the present can have various liquid resistant properties, antimicrobial properties including antiviral properties, and can provide a barrier to multiple fluids and liquids that the wearer may contact.

In one embodiment, the fabric material is used to construct protective garments for use in the medical industry. In this application, the protective garment can protect the user from blood, other body fluids, saline solutions and other fluids from penetrating or striking through the fabric. The fabric material also provides antimicrobial properties in addition to preventing respiratory droplets containing pathogens from penetrating the fabric material. Although the fabric material can be designed to be disposable, in one embodiment, the fabric material and protective garment made from the fabric material are reusable and can undergo multiple laundry cycles and still retain the desired barrier properties.

When used in the healthcare industry, the protective garment of the present disclosure can be rated according to the Association for the Advancement of Medical Instrumentation (AAMI).

The AAMI uses two tests developed by the American Association of Textile Colorists and Chemists ("AATCC"). AATCC 42 measures a material's water resistance by impact penetration. The material to be tested is held at a 45-degree angle while a fixed amount of water is sprayed on it. A blotter affixed under the material is weighed before and after the water is sprayed to determine how much water penetrated the fabric. According to the present AAMI standard, the material is classified as Level 1 if the weight gain of the blotter is no more than 4.5 grams.

For present AAMI Level 2, the material to be tested must satisfy two AATCC tests—AATCC 42 and AATCC 127. The first test, AATCC 42, is the same as that used for Level 1 except that the increase in the blotter's weight must be no more than 1 gram. The additional test is AATCC 127 which measures a material's resistance to water penetration under hydrostatic pressure. Under this test, a sample of the material to be tested is clamped in place horizontally on the bottom of a glass, metered cylinder. Hydrostatic pressure is increased steadily by increasing the amount of water in the cylinder. To be acceptable for use as a present AAMI Level 2 barrier, the material must be able to resist the penetration of water when it reaches a level of 20 cm.

For present AAMI Level 3, both of the AATCC test methods described above must be satisfied, similar to the requirements to meet the present AAMI Level 2. For AATCC 42, the maximum blotter weight gain is the same as that for Level 2 (i.e., 1 gram). For AATCC 127 to be acceptable for use as a present AAMI Level 3 barrier, the level of water in the cylinder used in AATCC 127 must be at least 50 cm.

For present AAMI Level 4, the AAMI uses two tests developed by the American Society for Testing Materials ("ASTM")-F1670/F1670M-17a for liquid penetration (i.e., surrogate blood) and F1671/F1671M-13 for viral penetration (i.e., bacteriophage Phi-X174). For surgical gowns and other protective apparel, the material must meet the viral challenge of F1671/F1671M-13 which measures the resistance of materials to bloodborne pathogens using viral penetration at 2 psi and ambient pressure. For surgical drapes and accessories, the material must meet the liquid challenge of F1670/F1670M-17a which measures the resistance of drape materials to penetration by synthetic blood at 2 psi and ambient pressure. For both tests, the results are expressed as pass or fail rather than in terms of a material's resistance.

For ASTM F1671/F1671M-13, the material must pass the test for resistance to penetration by bacteriophage Phi-X174. A sample of the material to be tested is placed vertically in a test cell as a membrane between the media challenge (i.e., liquid) and a viewing chamber. Materials that permit penetration during an hour of a prescribed series of changes in air pressure are not considered suitable for use. For ASTM F1670/F1670M-17a, the material must pass the test for resistance to penetration by synthetic blood. As in the test for viral penetration, the material to be tested is mounted in a vertical position on a cell that separates the surrogate blood liquid challenge and the viewing chamber. The test is terminated if visible liquid penetration occurs at any time before or during 60 minutes of changes in pressure and atmospheric protocols.

Protective garments made in accordance with the present disclosure can pass the AAMI Level 1, the AAMI Level 2, the AAMI Level 3 and/or the AAMI Level 4 requirements as described above. In particular, the protective garment (including all seams) can display an impact penetration according to Test AATCC 42 of one gram or less and can display a hydrostatic pressure according to Test AATCC 127 of 50 cm or greater. In addition, the protective garment can also pass European standards, such as test EN13795 and EN14126.

When designed to pass the AAMI Level 4 requirements, the fabric material can be a laminate. For example, laminates comprising (i) a woven or non-woven fabric and (ii) an extruded film can be used. In one aspect, the laminate can include a film layer positioned between two outer fabric layers. The film layer can be a microporous poly-tetrafluoroethylene (PTFE) film layer or made from polyester elastomers which are all block copolymers containing 60-70% of a hard (crystalline) segment of polybutylene terephthalate and the balance a soft (amorphous) segment based on long chain polyether glycols. While the soft segments are preferably based on long chain polyethylene glycols, comparable long chain polyether glycols, such as long chain polypropylene glycols, also are suitable. The one or more outer fabric layers can be nonwoven, woven or knitted fabrics. The woven or non-woven fabric used in the laminate can be any fabric which is suitable for use in protective garments for the outdoors (e.g. rainwear, skiwear) or a medical setting. Examples of suitable fabrics are polyester, nylon, polypropylene, Dupont Sontara®, tricot knit cloth nylon or brushed polyester.

As described above, protective garments of the present disclosure can be designed to be reusable. For example, protective garments made according to the present disclosure can maintain a desired AAMI Level rating even after 60 laundry cycles, such as greater than 75 laundry cycles, such as greater than 85 laundry cycles, such as greater than 100 laundry cycles, such as even greater than 105 laundry cycles. As used herein, a laundry cycle with respect to an AAMI Level rating is according to "Care Code ST." A laundry cycle not only includes laundering of the protective garment but also a sterilization protocol. One laundry cycle in conjunction with a sterilization protocol is as follows:

| Operation | Time | Water Level | Water Temperature | Supplies - 100 lbs |
|---|---|---|---|---|
| 1. Flush | 3 min | High | Cold | |
| 2. Flush | 3 min | High | Cold | |
| 3. Break | 10 min | Low | 160° F. | (8 oz. nonionic detergent - 8 oz. alkali Max pH-10.0) |
| 4. Rinse | 3 min | High | 140° F. | |
| 5. Extract | 3 min | | | |
| 6. Rinse | 2 min | High | 120° F. | |
| 7. Rinse | 2 min | High | 100° F. | |
| 8. Rinse | 2 min | High | Cold | |
| 9. Sour | 5 min | Low | Cold | Sour to pH 6.0 (citric acid) |
| 10. Extract | 3-5 min | | | |

Vacuum Steam Sterilization Protocol:
Temperature: 134° C./274° F.
Exposure Time: 4 minutes
Exhaust Time: 20 minutes Fabric materials treated in accordance with the present disclosure can have a spray rating of at least 70 or higher, such as at least 80 or higher, such as at least 90 or higher even after ten laundry cycles. In one embodiment, for instance, the fabric can maintain a 100 spray rating after ten laundry cycles.

Similarly, the fabric material can also display excellent resistance to water absorption. For example, when tested according to the water absorption test (NFPA 1971 8.25), the fabric can have a water absorption of about 15% or less, such as about 10% or less, such as about 5% or less, such as about 4% or less, such as about 3% or less, such as about 2% or less, such as about 1% or less.

The above water absorption properties can be retained by the fabric after 5 laundry cycles or even after ten laundry cycles.

In addition to water, fabric materials treated in accordance with the present disclosure also provide protection against various chemical agents such as acids, alkaline materials, and artificial blood when tested according to test EN ISO 6530. For example, when tested against a 30% sulfuric acid solution, fabric materials made according to the present disclosure can have an index of repellency of greater than about 85%, such as greater than about 90%, such as greater than about 92%, such as greater than about 94%. The fabric material can have an index of penetration when tested against a 30% sulfuric acid solution of less than about 5%, such as less than about 2%, such as less than about 1%, such as less than about 0.5%. When the fabric material is incorporated into a composite, such as a three layer composite, the index of penetration can be 0%.

When tested against a 10% sodium hydroxide solution, fabric materials made according to the present disclosure can display an index of repellency of greater than about 90%, such as greater than about 92%, such as greater than about 94%, such as greater than about 96%, such as greater than about 97%. The fabric materials can display an index of penetration of less than about 2%, such as less than about 1.5%, such as less than about 1%, such as less than about 0.8%.

Fabric materials made according to the present disclosure also display excellent resistance to artificial blood. When tested against artificial blood, for instance, fabric materials made according to the present disclosure can display an index of repellency of greater than about 85%, such as greater than about 87%, such as greater than about 90%, such as greater than about 92%, such as greater than about 94%. The fabric materials can display an index of penetration against artificial blood of less than about 4%, such as less than about 1.5%, such as less than about 1%, such as less than about 0.8%.

Regarding the antimicrobial or antiviral properties of fabric materials treated in accordance with the present disclosure, the fabric materials can be designed to pass ISO Test 18184 (2019). In one aspect, the test can be modified by utilizing the human coronavirus strain H-CoV-OC43, and by preconditioning the liquid repellent test fabrics with a surfactant solution to simulate worst-case fluid exposure conditions. The viral challenge strain remaining on the product is measured for infectivity to determine the viral burden reduction efficacy.

Figure 7:
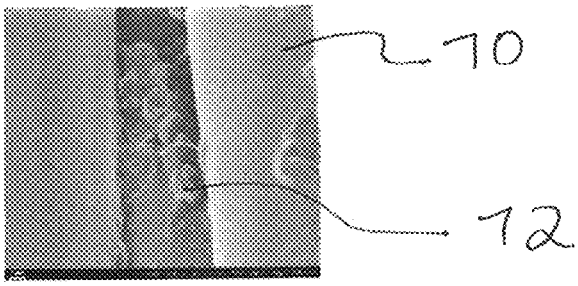
FIG. 7 and FIG. 8 are enlarged pictures of a fabric treated in accordance with the present disclosure.
Figure 8:
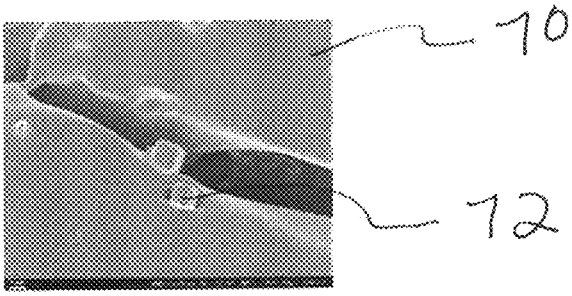
Figure 9:
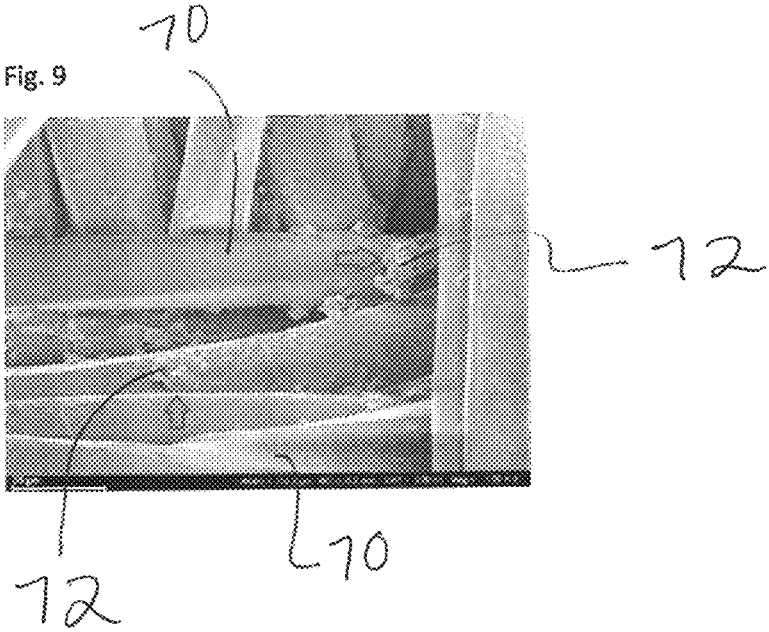
FIG. 9 is an enlarged picture illustrating a fabric treated in accordance with the present disclosure after 20 laundry cycles.

Referring to FIGS. 7-9, enlarged pictures illustrating fabric materials treated in accordance with the present disclosure are illustrated. As shown in FIGS. 7 and 8, for instance, the fabric material includes fibers 70. Clearly shown located on the fibers 70 are antiviral agents 72, which can comprise zeolite particles containing metal ions, such as silver ions or silver and copper ions. As shown in FIGS. 7 and 8, the antiviral agents 72 are attached to the fibers 70 through the use of a durable water resistant composition and/or a binder. In fact, a treatment is visible on the fibers comprising a durable water resistant composition.

Referring to FIG. 9, another picture of the same fabric material illustrated in FIGS. 7 and 8 is shown, In FIG. 9, however, the picture is taken after 20 laundry cycles. As shown, even after 20 laundry cycles, the antiviral agents 72 remain affixed to the fiber 70.

The fabric material treated in accordance with the present disclosure can be a single layer fabric or a multilayer fabric. The fibers used to make the fabric can depend upon the particular end use application. The fabric material can also contain a woven fabric, a nonwoven fabric, a knitted fabric, a film, and combinations thereof.

Figure 2:
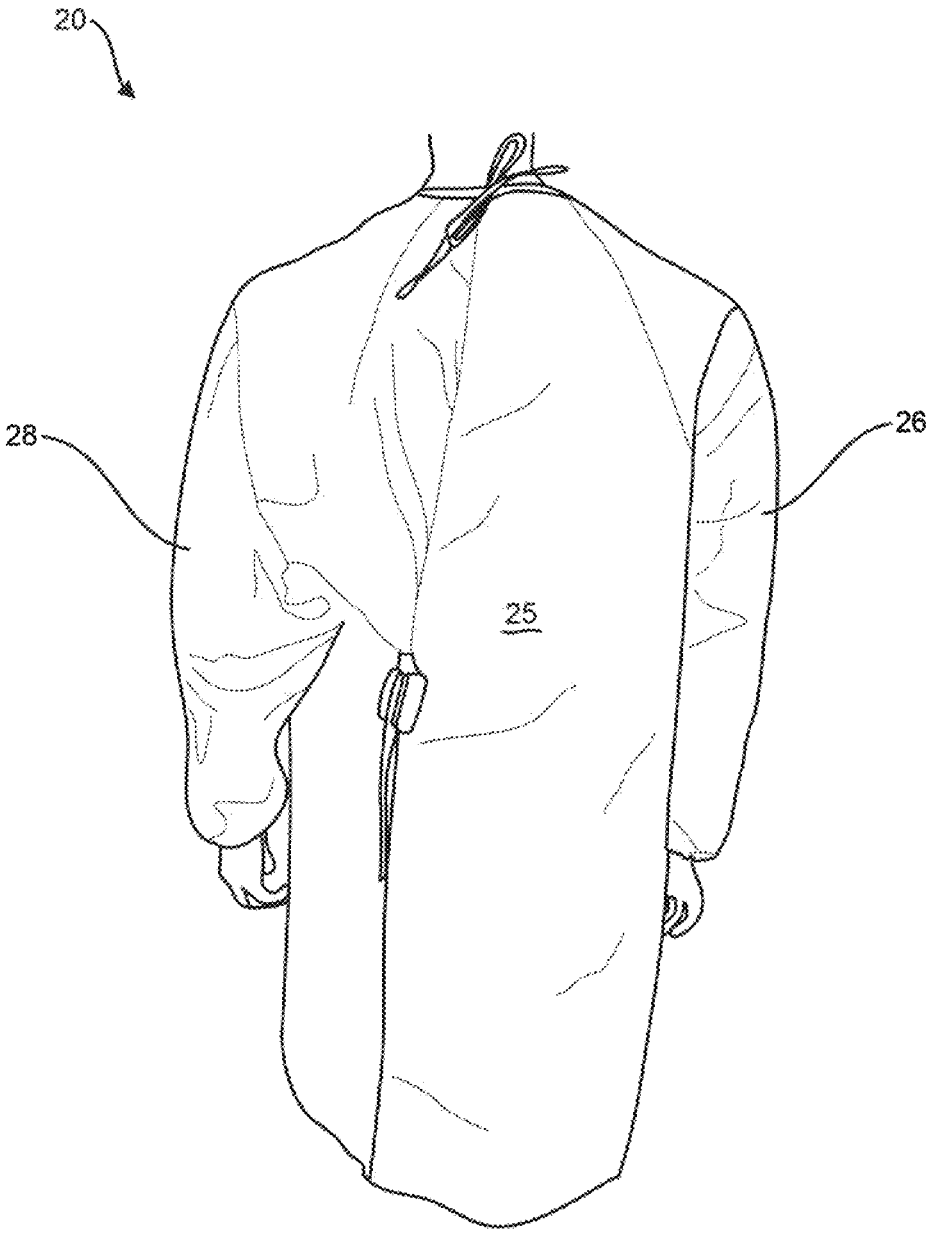
FIG. 2 is a perspective view of one embodiment of a back of a protective garment made in accordance with the present disclosure.

For exemplary purposes only, one embodiment of a protective garment for the medical industry is illustrated in FIGS. 1 and 2. As shown, protective garment 20 can include a body portion 22 that can include a front 24 and a back 25. The body portion 22 can be connected to a first sleeve 26 and a second sleeve 28. The protective garment 20 can be made from a single piece of fabric. In order to form the first sleeve 26 or the second sleeve 28, the fabric can be connected together along a first seam 30 and a second seam 32. Each seam can be formed by stitching the opposing material together. In one embodiment, the seam can be formed by two parallel rows of stitching. The seam can be made according to U.S. Pat. No. 6,680,100, which is incorporated herein by reference.

The fabric that is used to construct the garment illustrated in FIG. 1 can be any suitable fabric material. For example, the fabric can be a woven fabric, a nonwoven fabric, or a knitted fabric.

In one aspect, the protective garment 20 is formed from a polyester woven fabric. For instance, the fabric can contain greater than 80%, such as greater than 90%, such as 100% by weight polyester fibers. The fabric can be formed from polyester yarns. In one aspect, the polyester yarns are formed from continuous filaments, such as polyester multifilament yarns. The yarns in both the warp direction and the fill direction can generally have a relatively low denier. For instance, the yarns can have a denier of less than about 300, such as less than about 200, such as less than about 150, such as even less than about 100. The denier of the yarns is greater than about 10, such as greater than about 50. Each yarn can contain at least about 10 filaments, such as at least about 20 filaments, such as at least about 30 filaments, such as at least about 40 filaments, and generally less than about 100 filaments, such as less than about 70 filaments, such as less than about 60 filaments. In one aspect, the yarn has a denier of from 70 to 75 and contains 30 to 50 filaments per yarn.

In addition to polyester yarns, in one embodiment the fabric can contain anti-static fibers and yarns. For example, anti-static yarns can comprise bicomponent filaments that include a polymer core surrounded by a carbon sheath.

Each yarn can include a single end or can include two ends. Optionally, the yarns can be textured. In such yarns, the filaments are distorted from their generally rectilinear condition to increase the bulk of the yarn and also to provide an ability for a fabric woven therefrom to stretch. A textured yarn may be "set" by heat relaxation to minimize its stretch characteristic, while maintaining its increased bulk, i.e., higher bulked denier.

There are several types of textured yarns capable of being produced by various methods. Different types of textured yarns have different characteristics, some being more expensive than others. The textured yarns that may be employed in the present fabric constructions, or referenced herein, are:

(1) False twist yarn is twisted in one direction, set, then twisted in the opposite direction and set. The twisting, setting, opposite twisting are repeated throughout the length of the yarn.

(2) Core and effect yarn (also known as "core bulked" yarns) is a multiple ended yarn, usually comprising two ends in which one end is essentially straight. The filaments of other end are distorted around the core end and sometimes through the core end.

(3) Air texturized core and effect yarn—is a core and effect yarn in which distortion of the filaments is done by air jet means. An air texturized core and effect yarn has unique properties which distinguish it from other textured yarns. These unique properties have been found effective in attaining the ends herein sought.

In addition to using relatively low denier yarns, the fabric material of the present disclosure can also have a relatively high yarn density. For instance, in the warp direction, the fabric can have greater than about 80 yarns per inch, such as greater than about 100 yarns per inch, such as greater than about 110 yarns per inch, such as greater than about 120 yarns per inch, such as greater than about 130 yarns per inch, such as greater than about 140 yarns per inch, such as greater than about 150 yarns per inch, and generally less than about 200 yarns per inch, such as less than about 180 yarns per inch. In the fill direction, the yarn density can be greater than about 60 yarns per inch, such as greater than about 65 yarns per inch, such as greater than about 70 yarns per inch, such as greater than about 75 yarns per inch, such as greater than about 80 yarns per inch, such as greater than about 85 yarns per inch, and generally less than about 120 yarns per inch, such as less than about 100 yarns per inch, such as less than about 95 yarns per inch.

The fabric material of the present disclosure can also be calendered. Calendering can increase the barrier properties and reduce the permeability of the fabric. During calendering, the fabric is passed between a pair of pressure rolls wherein at least one of the rolls is heated. When a woven polyester fabric is calendered, the fabric is compressed and its density is increased as the interstices between the yarns and the filaments of the yarns are decreased.

The above fabric material represents just one type of fabric that can be treated in accordance with the present disclosure to produce the protective garment as shown in FIG. 1. In general, any suitable fabric can be treated in accordance with the present disclosure and formed into a protective garment for use in the medical field or in other fields. For instance, in other embodiments, the fabric material can be made exclusively from cotton fibers or can be made from a combination of cotton fibers and polyester fibers. The fibers used to make the fabric material can be staple fibers or can be continuous filament fibers that are used to make monofilament yarns and multifilament yarns. In still another embodiment, the fabric material can be made from a polyamide, such as nylon. The fabric material can be made exclusively from the polyamide fibers or can be a fiber blend of polyamide fibers with cellulose fibers, polyester fibers, or combination of all three fibers. Cellulose fibers that may be used include cotton fibers or regenerated cellulose fibers such as rayon fibers and viscose fibers.

Protective garments for use in medical industry generally have a light basis weight. For example, the basis weight can be from about 0.5 osy to about 4 osy.

In another aspect, the protective garment of the present disclosure can be designed to be worn by those in the fire service industry. For example, the fabric material can contain flame resistant fibers, such as inherently flame resistant fibers or fibers treated with a flame retardant.

For example, the fabric may be used to construct a garment worn by firefighters. For instance, referring to FIG. 3, one embodiment of a fireman turnout coat 10 constructed in accordance with the present disclosure is illustrated. Garment 10 includes a relatively tough outer shell 12 having a liner assembly 14 located therein. Outer shell 12 and liner assembly 14 together function to protect a wearer from heat and flame such as may be encountered during firefighting activities.

In the illustrated embodiment, liner assembly 14 is constructed as a separate unit that may be removed from outer shell 12. A zipper 16 is provided for removably securing liner assembly 14 to outer shell 12. It should be appreciated, however, that other suitable means of attachment, including a more permanent type of attachment such as stitches, may also be used between liner assembly 14 and outer shell 12.

Figure 4:
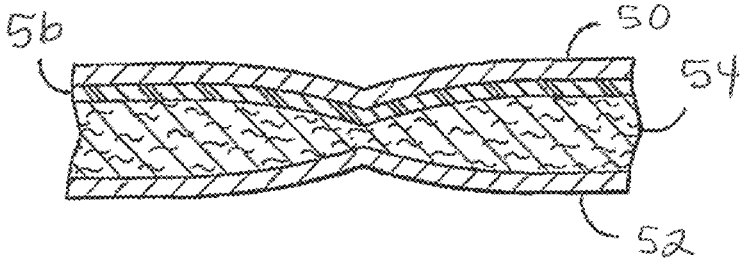
FIG. 4 is a cross-sectional view of an inner liner that may be incorporated into the garment illustrated in FIG. 3.
Figure 5A:
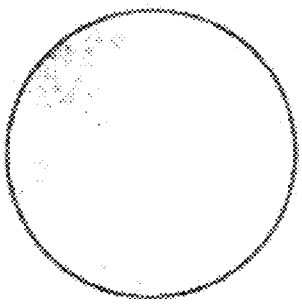
FIGS. 5A-5F are diagrammatical views of illustrated examples of spray ratings for a standardized fabric spray test.
Figure 5B:
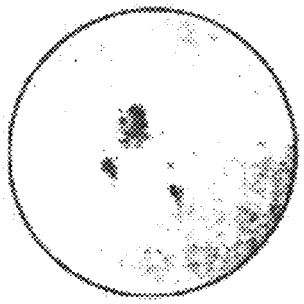
Figure 5C:
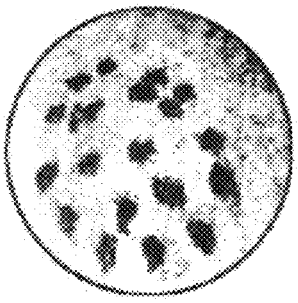
Figure 5D:
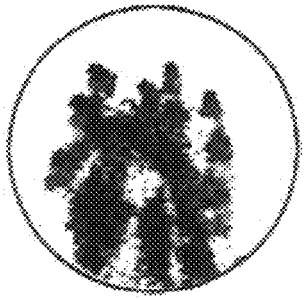
Figure 5E:
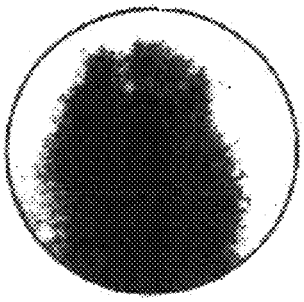
Figure 5F:
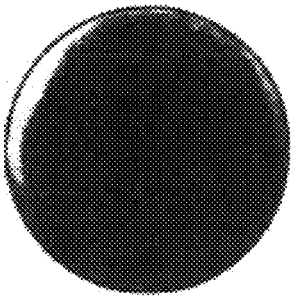

The construction of protective garment 10 is more particularly illustrated in FIG. 4. As shown, liner assembly 14 includes a plurality of material layers quilted together. The outermost layers, i.e. lining layers 50 and 52, are connected together about their respective peripheries to form an inner cavity. A thermal barrier layer 54 and a moisture barrier layer 56 are located within the inner cavity, as shown. Typically, lining layer 50 will be adjacent the wearers body during use, whereas lining layer 52 will be adjacent outer shell 12.

Thermal barrier layer 54 can be made from various materials. For instance, an aramid felt, such as a felt produced from NOMEX meta-aramid fibers obtained from DuPont can be used. The felt functions as an insulator to inhibit transfer of heat from the ambient-environment to the wearer.

Moisture barrier 56 is preferably a suitable polymeric membrane that is impermeable to liquid water but is permeable to water vapor. Moisture barrier layer 56 is designed to prevent water contacting the exterior surface of garment 10 from reaching the wearer while at the same time permitting the escape of perspiration from the wearer.

In the embodiment described above, the fireman turnout coat 10 includes multiple layers. In other embodiments, however, it should be understood that a coat or jacket made in accordance with the present disclosure may include a single layer or may include an outer shell attached to a liner. For example, wildland firefighter garments are typically one or two layers.

Figure 6:
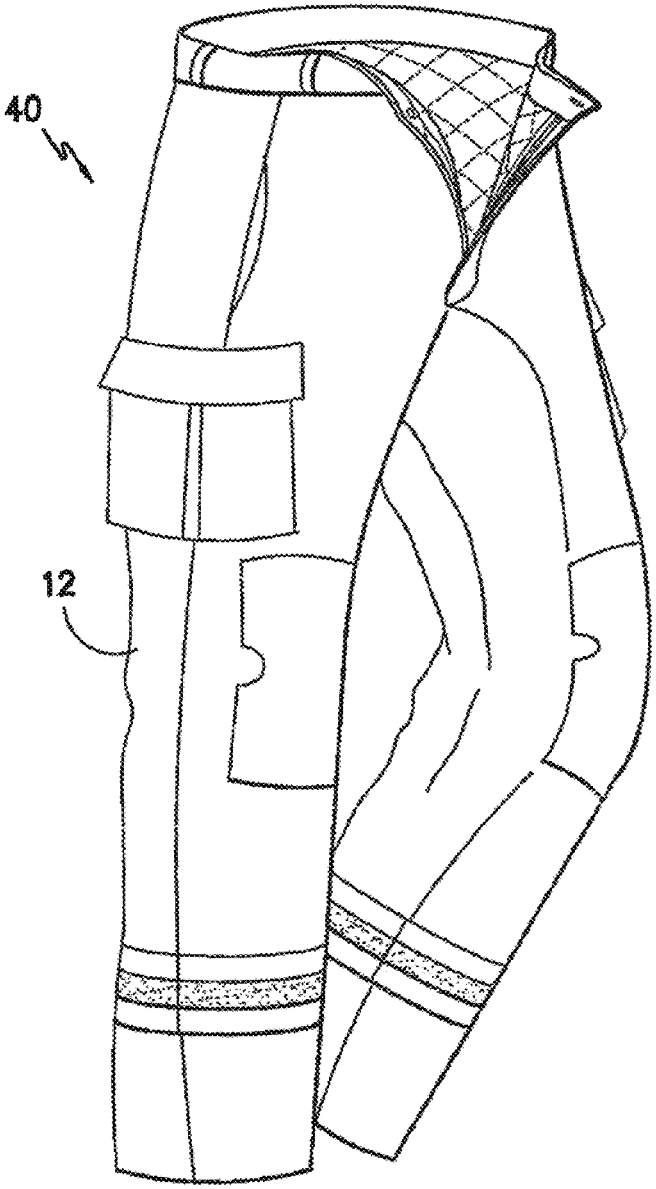
FIG. 6 is a perspective view of one embodiment of a protective garment comprising trousers made in accordance with the present disclosure.

Referring to FIG. 6, a pair of trousers made in accordance with the present disclosure is shown. The trousers 40 as shown in FIG. 6 can be used in conjunction with the turnout coat 10 illustrated in FIG. 3. The trousers 40 also include an outer shell 12 made from the fabric of the present disclosure.

Figure 3:
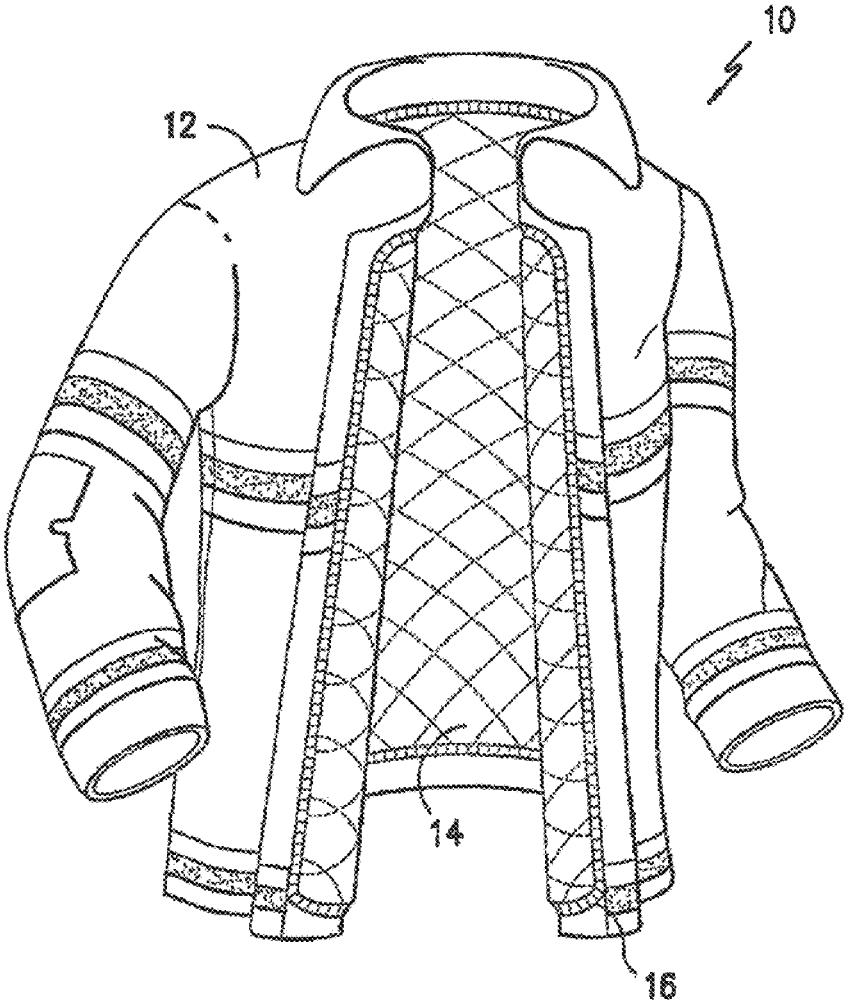
FIG. 3 is a perspective view of another embodiment of a protective garment made in accordance with the present disclosure.

Any of the fabric layers illustrated in the figures can be treated in accordance with the present disclosure. For instance, the outer shell 12, the lining layer 50, the lining layer 52, and/or the thermal barrier layer 54 as shown in FIGS. 3 and 6 can be treated in accordance with the present disclosure with a water resistant and antimicrobial treatment. The fabric material can be a woven or knitted fabric and, in one embodiment, contains inherently flame resistant fibers. For example, the fabric material can contain inherently flame resistant fibers in an amount greater than about 50% by weight, such as in an amount greater than about 60% by weight, such as in an amount greater than about 70% by weight, such as in an amount greater than about 80% by weight, such as in an amount greater than about 90% by weight, such as in an amount greater than about 95% by weight. In one embodiment, for instance, the fabric material is made exclusively from inherently flame resistant fibers or contains inherently flame resistant fibers in an amount up to about 97% by weight, such as about 98% by weight.

The inherently flame resistant fibers can include, for instance, aramid fibers such as para-aramid fibers and/or meta-aramid fibers. Other inherently flame resistant fibers include polybenzimidazole (PBI) fibers or poly(p-phenylene-2,6-bezobisoxazole) (PBO fibers) and the like. In one embodiment, for instance, the fabric material only contains aramid fibers such as para-aramid fibers alone or in combination with meta-aramid fibers. In still another embodiment, the fabric material contains only meta-aramid fibers. In still another embodiment, the fabric material contains aramid fibers in combination with PBI fibers. The PBI fibers can be present in the fabric material, for instance, in an amount greater than about 20% by weight, such as in an amount greater than about 25% by weight, such as in an amount greater than about 30% by weight, such as in an amount greater than about 35% by weight, such as in an amount greater than about 40% by weight, such as in an amount greater than about 45% by weight, such as in an amount greater than about 50% by weight, and generally in an amount less than about 70% by weight, such as in an amount less than about 60% by weight.

In addition to any of the inherently flame resistant fibers described above, the fabric material may contain other fibers. For instance, the fabric material may also include fibers treated with a flame retardant such as FR cellulose fibers including FR viscose fibers and FR rayon fibers. In addition, the fabric material may include antistatic fibers, nylon fibers, and the like. For example, a fabric materials treated in accordance with the present disclosure can contain nylon fibers in an amount up to about 20% by weight. For instance, nylon fibers can be present in an amount of from about 18% to about 2% by weight, such as from about 15% to about 8% by weight.

The yarns used to produce the fabric material can vary depending upon the particular application and the desired result. In one embodiment, for instance, the fabric material may contain only spun yarns, may contain only filament yarns, or may contain both spun yarns and filament yarns. The number ratio between spun yarns and filament yarns, for instance, can be from about 1:1 to about 10:1. For example, in one embodiment, the fabric material may contain spun yarns to filament yarns in a number ratio of from about 2:1 to about 4:1. When the fabric material is a woven fabric, the fabric can have any suitable weave such as a plain weave, a twill weave, a rip stop weave, or the like.

In one embodiment, the filament yarns may be made from an inherently flame resistant material. For example, the filament yarns may be made from an aramid filament, such as a para-aramid or a meta-aramid filament.

In other embodiments, the filament yarns may be made from other flame resistant materials. For instance, the filament yarns may be made from poly-p-phenylenebenzobisoxazole fibers (PBO fibers), and/or FR cellulose fibers, such as FR viscose filament fibers.

The filament yarns can be combined with spun yarns. Alternatively, the fabric material can be made using only filament yarns or only spun yarns. In accordance with the present disclosure, the spun yarns, in one embodiment, may contain polybenzimidazole fibers alone or in combination with other fibers. For example, in one embodiment, the spun yarns may contain polybenzimidazole fibers in combination with aramid fibers, such as para-aramid fibers, meta-aramid fibers, or mixtures thereof.

Instead of or in addition to containing polybenzimidazole fibers, the spun yarns may contain aramid fibers as described above, modacrylic fibers, preoxidized carbon fibers, melamine fibers, polyamide imide fibers, polyimide fibers, and mixtures thereof.

In one particular embodiment, the spun yarns contain polybenzimidazole fibers in an amount greater than about 30% by weight, such as in an amount greater than about 40% by weight. The polybenzimidazole fibers may be present in the spun yarns in an amount less than about 60% by weight, such as in an amount less than about 55% by weight. The remainder of the fibers, on the other hand, may comprise para-aramid fibers.

In one embodiment, various other fibers may be present in the spun yarns. When the fabric is used to produce turnout coats for firemen, the spun yarns can be made exclusively from inherently flame resistant fibers. When the fabric is being used in other applications, however, various other fibers may be present in the spun yarns. For instance, the spun yarns may contain fibers treated with a fire retardant, such as FR cellulose fibers. Such fibers can include FR cotton, FR rayon, FR acetate, FR triacetate, and FR lyocell, and the like. The spun yarns may also contain nylon fibers if desired, such as antistatic fibers.

The basis weight of the fabric material can vary depending upon the particular type of protective garment being produced. The weight of the outer shell material, for instance, is generally greater than about 4 ounces per square yard, such as greater than about 5 ounces per square yard, such as greater than about 5.5 ounces per square yard, such as greater than about 6 ounces per square yard and generally less than about 8.5 ounces per square yard, such as less than about 8 ounces per square yard, such as less than about 7.5 ounces per square yard.

In another aspect, the fabric material treated in accordance with the present disclosure is a liner fabric. The liner fabric, for instance, can be positioned adjacent to the wearer's body during use. The lining fabric can be made from a combination of spun yarns and filament yarns as described above. The filament yarns can have a size of greater than about 100 denier, such as greater than about 200 denier, and less than about 500 denier, such as less than about 400 denier. In order to increase the lubricity of the liner fabric, the spun yarns and filament yarns can be woven together such that the filament yarns comprise more than about 50% of the surface area of one side of the fabric. For instance, the filament yarns may comprise greater than about 60%, such as greater than about 70%, such as greater than about 80% of one side of the fabric. The side of the fabric with more exposed filament yarns is then used as the interior face of the garment. The filament yarns provide a fabric with high lubricity characteristics that facilitates donning of the garment. For example, the lining fabric can be woven together using a twill weave, such as a 2×1 or 3×1 weave. The lining fabric can have a basis weight of less than about 5 ounces per square yard, such as less than about 4 ounces per square yard, and generally greater than about 2.5 ounces per square yard, such as greater than about 3 ounces per square yard.

In another aspect, the fabric material treated in accordance with the present disclosure is the barrier layer 54 as shown in FIG. 4. Barrier layer 54, for instance, can comprise a batting material, such as a felt.

The present disclosure may be better understood with reference to the following example.

Example

Various different fabric samples were treated with different compositions and tested for antimicrobial activity and water resistance.

The fabric samples were treated with a silver base solution. In certain samples, the silver base solution was combined with a durable water resistant composition. One durable water resistant composition was formulated to contain a fluorocarbon while another was formulated to be fluorocarbon free. The treatment applied to each fabric was completed using a pad-dry-cure method. An acrylic based binder was present in each formulation. The fabric was immersed in the solution containing 1% to 1.5% by weight antimicrobial agent and passed through a padder with 70 to 90% by weight wet pickup.

The following fabrics were tested:

- A lightweight (2.5 Oz/SqYd-4.38 Oz/LinYd) 100% Polyester fabric with plain weave and
- A 6.25 Oz/LinYd fabric made of 45% Nomex/32% Lenzing FR/17% Nyon/6% Kevlar
- A 6.0 Oz/LinYd fabric made of 62% Kevlar/36% PBI/2% AS with twill weave Assessment of Antibacterial Activity:

ASTM E2149 (Standard Test Method for Determining the Antimicrobial Activity of Antimicrobial Agents Under Dynamic Contact Conditions) standard was used as a quantitative method to evaluate antimicrobial activity of treated fabrics. Broth cultures of test organisms including *Staphylococcus aureus* (*S. aureus*—ATCC6538) and *K. pneumoniae*—ATCC4352 were used as inoculums as a reference for gram positive and gram negative bacteria respectively. The antimicrobial activity is expressed in terms of percentage reduction of microorganism after contact with the test specimen compare to the number of microbial cells surviving after contact with untreated control. Tests were conducted on the fabrics after 20, 50 and 75 laundry cycles.

| | Antibacterial ASTM E2149 (*S. Aureus*) | | | | Antibacterial ASTM E2149 (*K. Pneumoniae*) | | | |
|---|---|---|---|---|---|---|---|---|
| Sample Description | Original | 20X | 50X | 75X | Original | 20X | 50X | 75X |
| 4040 treated with Antiviral + Non-Fluorinated DWR | 99.99 | 99.99 | 99.9 | 98.7 | 99.99 | 99.99 | 99 | 99.99 |
| 4040 treated with Antiviral + Fluorinated DWR | 99.99 | 99.99 | 99 | 99 | 99.99 | 99.99 | 99.99 | 99.99 |
| 4045 treated with Antiviral + Fluorinated DWR | 99.99 | 99.99 | 99.99 | 99.99 | 99.99 | 99.99 | 99.99 | 99.99 |

Assessment of Water Repellent Properties:

Spray Test (AATCC 22) is used to measure the resistance of a material to wetting by water. The fabric sample is fastened securely on a 6" metal hoop so that the fabric is wrinkle free. A funnel attached to a nozzle for holding water is placed 6" above the center of the fabric and 250 milliliters of water at 80 plus or minus 2° F. are poured from a cup or other into the funnel, allowing the water to spray onto the fabric.

| Sample Description | Impact Penetration ATCC 42 | | | | Spray AATCC 22 | | | |
|---|---|---|---|---|---|---|---|---|
| | Original | 20X | 50X | 75X | Original | 20X | 50X | 75X |
| Sigma treated Antiviral + Non-Fluorinated DWR | 0.1 | 0.1 | 0.4 | 0.8 | 100 | 70 | 70 | 70 |
| 4040 treated with Antiviral + Non-Fluorinated DWR | 0.1 | 0.1 | 0.2 | 0.2 | 100 | 80 | 80 | 80 |
| 4040 treated with Antiviral + Fluorinated DWR | 0.1 | 0 | 0.2 | 0.2 | 100 | 100 | 100 | 100 |
| 4045 treated with Antiviral + Fluorinated DWR | 0 | 0 | 0.2 | 0.2 | 100 | 100 | 100 | 90 |

Assessment of Antiviral Activity:

A modification of standard test method ISO 18184 is used for assessment of Human coronavirus OC43 viral burden reduction by treated fabric products. The test articles with Durable Water Repellent (DWR) finish is pre-conditioned by soaking in a 2% Tween neutralizing (SCDLP) solution for 30 minutes then rinsed with sterile, deionized water 4 times. Samples are dried out for 30 minutes and then rubbed with a pre-ethanoled nitrile glove prior to inoculation. Test samples and fabric-free controls were inoculated with a concentration (relevant to that encountered in the healthcare environment) of virus and incubated at 35° C. for 0 or 2 hours. Following incubation, virus remaining on the test article and fabric-free controls was recovered by the addition of recovery medium for dilution and plating onto cell culture plates. The cell culture plates were then incubated overnight at 37° C. and the resulting viral foci was counted for quantitative results. The viral burden reduction efficacy was determined following the 0 and 2 hour incubation times of the test articles and controls. Each original state ("Ox") test article reduced viral burden relative to the fabric-free (negative) control by at least 4-logs. The style 4040 treated with antiviral+fluorinated DWR displayed a 6 log reduction of the virus versus a control at 2 hours. The Sigma treated with antiviral+Non-Fluorinated DWR showed a 6 log reduction of the virus versus control at 2 hours.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only and is not intended to limit the invention so further described in such appended claims.

What is claimed:

1. A protective garment comprising:

a fabric material comprising a woven fabric, a knitted fabric, a nonwoven fabric, or combinations thereof, the fabric material having a basis weight from 0.5 osy to 4 osy, the fabric material comprising polyester in an amount greater than 80 wt. %, the fabric material having a yarn density in a warp direction of from 100 yarns per inch to 180 yarns per inch and in a fill direction of from 60 yarns per inch to 120 yarns per inch, the fabric material including a combined water resistant and antimicrobial treatment, the water resistant and antimicrobial treatment containing a combination of a durable water resistant composition and an antiviral composition, the durable water resistant composition comprising a repelling agent and an extender in a weight ratio from 8:1 to 1:3, the antiviral composition including at least one antiviral agent, wherein the antiviral composition comprises a ceramic carrier for the antiviral agent, wherein the antiviral agent comprises one or more ceramic particles, wherein at least a portion of the one or more ceramic particles comprises one or more antiviral metal ions, wherein the weight of the one or more antiviral metal ions of at least one ceramic particle is from 0.1% to 35% based on the total weight of the at least one ceramic particle;

wherein the protective garment is a medical garment or a lab coat.

2. The protective garment as defined in claim 1, wherein the antiviral agent comprises silver ions.

3. The protective garment as defined in claim 2, wherein the antiviral composition includes silver ions in combination with copper ions.

4. The protective garment as defined in claim 1, wherein the antiviral agent comprises a silver-containing material, a copper-containing material, a quaternary compound, a pyrithione, a chitosan, triclosan, or mixtures thereof.

5. The protective garment as defined in claim 1, wherein the water resistant and antimicrobial treatment contains less than 1000 ppm of one or more fluorocarbons.

6. The protective garment as defined in claim 5, wherein the durable water resistant composition further comprises a binder, wherein the binder comprises a polyurethane polymer.

7. The protective garment as defined in claim 6, wherein the polyurethane polymer comprises an aliphatic polyester/ether polyurethane polymer.

8. The protective garment as defined in claim 5, wherein the repelling agent comprises an acrylic polymer.

9. The protective garment as defined in claim 5, wherein the repelling agent comprises a wax.

10. The protective garment as defined in claim 9, wherein the wax comprises a paraffin wax.

11. The protective garment as defined in claim 5, wherein the durable water resistant composition further comprises a binder, the binder comprising a first polyurethane polymer, wherein the extender comprises a second polyurethane polymer.

12. The protective garment as defined in claim 11, wherein the first polyurethane polymer comprises an aliphatic polyester/ether polyurethane polymer and the second polyurethane polymer comprises a blocked isocyanate.

13. The protective garment as defined in claim 1, wherein the protective garment maintains at least Level 2 protection according to ANSI/AAMI PB70: 2012 after 60 laundry cycles in accordance with NFPA 1971, 8-1.2.

14. The protective garment as defined in claim 1, wherein the fabric material includes a film layer positioned in between a first outer fabric layer and a second outer fabric layer.

15. The protective garment as defined in claim 1, wherein the ceramic carrier is zeolite.

16. The protective garment as defined in claim 1, wherein the one or more antiviral metal ions are ion-exchanged metal ions, wherein the antiviral agent is present on the fabric in an amount from 0.01% to 30% by weight.

17. The protective garment as defined in claim 1, wherein the fabric material is a single layer fabric material.

18. A protective garment comprising:

a fabric material comprising a woven fabric, a knitted fabric, a nonwoven fabric, or combinations thereof, the fabric material having a basis weight from 5 osy to 8.5 osy, the fabric material having a yarn density in a warp direction of 180 yarns per inch or less and in a fill direction 120 yarns per inch or less, the fabric material comprising inherently flame resistant fibers in an amount greater than 70 wt. %, wherein a combined water resistant and antimicrobial treatment is applied to the fabric material, wherein the water resistant and antimicrobial treatment applied to the fabric material comprises a durable water resistant composition, an antiviral composition, and water, the durable water resistant composition comprising a repelling agent and an extender in a weight ratio from 8:1 to 1:3, the antiviral composition including at least one antiviral agent, wherein the antiviral composition comprises a ceramic carrier for the antiviral agent, wherein the antiviral agent comprises one or more ceramic particles, wherein at least a portion of the one or more ceramic particles comprises one or more antiviral metal ions, wherein the weight of the one or more antiviral metal ions of at least one ceramic particle is from 0.1% to 35% based on the total weight of the at least one ceramic particle;

wherein the protective garment is a fire-safety garment.

19. The protective garment as defined in claim 18, wherein the fabric material is a single layer fabric material.

20. The protective garment as defined in claim 18, wherein the fabric material comprises PBI fibers in an amount greater than 25 wt. %.

* * * * *